US005261735A

United States Patent [19]

Cohen et al.

[11] Patent Number: 5,261,735

[45] Date of Patent: Nov. 16, 1993

[54] DEPLOYABLE VIDEO CONFERENCE TABLE

[75] Inventors: Marc M. Cohen, Menlo Park; Peter Lissol, Redwood City, both of Calif.

[73] Assignee: The United States of America as represented by the Administrator of the National Aeronautics and Space Administration, Washington, D.C.

[21] Appl. No.: 829,839

[22] Filed: Feb. 3, 1992

[51] Int. Cl.[5] ..... A47B 77/10

[52] U.S. Cl. ..... 312/282; 108/3; 108/59

[58] Field of Search ..... 312/7.2, 270.3, 282, 312/313, 223.2, 223.1; 108/3, 59, 135, 50; 358/185

[56] References Cited

U.S. PATENT DOCUMENTS

| | | | |
|---|---|---|---|
| 4,011,404 | 3/1977 | Graham | 358/185 |
| 4,640,199 | 2/1987 | Zigman . | |
| 4,668,026 | 5/1987 | Lapeyre et al. . | |
| 4,836,114 | 6/1989 | Cohen et al. . | |
| 4,861,121 | 8/1989 | Gotz . | |
| 4,920,458 | 4/1990 | Jones . | |
| 4,961,607 | 10/1990 | Marshall, Sr. . | |
| 5,007,688 | 4/1991 | Bayerlein et al. . | |

*Primary Examiner*—Kenneth J. Dorner
*Assistant Examiner*—Gerald A. Anderson
*Attorney, Agent, or Firm*—Darrell G. Brekke; Guy Miller; John R. Manning

[57] ABSTRACT

A deployable table stowable in and deployable from a storage compartment based upon a non-self rigidizing 4-hinge arch support structure that collapses or folds upon itself to stow and that expands to deploy. The work surfaces bypass each other above and below each other to allow the deployment mechanism to operate. This assembly includes first and second primary pivot hinges disposed respectively at the opposite ends of the storage compartment, first and second lateral frame members having proximal ends connected respectively to the first and second pivot hinges, a medial frame member offset from and pivotally connected to distal ends of the first and second members through third and fourth medial pivot hinges, left-side, right-side and middle trays connected respectively to the first, second and third frame members and being foldable into and out of the storage compartment by articulation of the first, second, third and fourth joints. At least one of the third an fourth joints are locked to set the first, second and third frame members in a desired angular orientation with respect to each other.

20 Claims, 11 Drawing Sheets

DEPLOYABLE VIDEO CONFERENCE TABLE

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

1. Technical Field of Field of the Invention

The present invention relates generally to foldable and stowable tables and, more specifically to a deployable video conference table capable of being stowed and deployed as needed in close quarters.

2. Description of the Prior Art

Video conferencing involves the use of video cameras and viewers to provide the participants with visual as well as audio communication. Where space is not limited, video conference centers may employ any of a variety of known fixed conference tables, while the video cameras tend to be manned, mobile structures which can be positioned at any point around the table. Similarly, the viewers or monitors can be positioned at any point around the table which is most convenient for the participants seated at the table. Conference facilities typically accommodate several dozen people and their principal function seems to be for press conferences. Rarely are the video conference facilities used for "working sessions" in which the participants examine and share technical data, or engage in planning activities or make decisions as part of their work life.

Television studios are also utilized for viewing and monitoring multiple images at the same time. These use elaborate switch gear to assign images from individual cameras to specific monitors or to multiplex (videoplex) the images onto a single monitor screen. However, television production studios usually employ a number of different people including technicians and editors to operate this complicated equipment.

For aircraft or space vehicles, space is much more confined to the point that the typical video conference equipment used on earth is not practical to use. It is essential that any single crew member should easily be capable of operating the videoplexing functions and use the work station without becoming entangled in a complex operating system and that several crew members be able to share in the conference with access to the technical information displays and materials.

A wardroom table was used in space as part of the Skylab Project of NASA. However, this table was completely independent of any work station and had no specific relationship to video conference facilities. The Skylab table design included clamp-like leg restraints to keep the crew members at their place, while the table itself was designed with a minimal knowledge of zero-gravity neutral body posture and anthropometrics.

U.S. Pat. No. 4,836,114 describes an improvement over the table that was used in the Skylab Project. This table includes surfaces that are adjustable in angle to compensate for the changes and variations in sightline and body size of the various crew members in zero gravity.

Generally speaking, when NASA crews hold video conferences or press conferences in the space shuttle orbiter cabin, the crew members are gathered in front of a fixed camera in an upper corner or the mid deck ceiling, restraining themselves as well as possible on whatever hand holds are available or within reach. If a shuttle crew member needs to write while participating in the video conference, he or she must hold a clip board with one hand to restrain it from floating away while writing with the other hand.

Generally, video conference tables and conference centers, whether for terrestrial or space applications, suffer from several disadvantages. With respect to terrestrial facilities, they are designed and built for operation in 1-G, which means different ergonomic and anthropometric and body posture considerations than for space applications.

Also, conferencing techniques employed in the past for space lab missions, as well as for shuttle missions, suffer from the disadvantage that the crew members can be seen by conference participants on the ground, but the ground-based participants could not be seen by the crew members. This makes for a difficult interpersonal dynamic between the ground staff and crew members.

SUMMARY OF THE INVENTION

An object of the present invention is therefore to provide a deployable video conference table that is anthropometrically and ergonomically adjustable, especially for people doing long periods of work situated at a work station.

Another object of the present invention is to provide a deployable video conference table which is capable of being stowed in a small space and deployed to provide a relatively large surface area for use by multiple conference participants.

Another object of the present invention is to provide a deployable video conference table for a video dedicated work station in which crew members can control and participate in video conferences on more or less equal terms with ground-based personnel; and from which the crew can operate vital command, control, communication, and monitoring and operational functions at an "Element Control Work Station."

Another object of the present invention is to provide a deployable video conference table which is easy to deploy and capable of being manipulated by one crew member using only one hand.

Another object of the present invention is to provide a deployable conference table having commonality of hinge and rotational parts.

Still another object of the present invention is to provide a deployable video conference table based upon a 4-hinge arch structure that stows in a compartment by collapsing upon itself from deployed-to-stowed trapezoidal frame geometry.

Another object of the present invention is to provide a deployable video conference table based on a 4-hinge arch that deploys to expanded position into a trapezoid all frame geometry such that its work surfaces extend wider than the rack from which they are deployed.

Still another object of the present invention is to provide an interleaving hinge structure that allows the connected members of a frame to bypass each other by passing above and below each other during articulation of the frame members.

These and other objects of the present invention will be met by providing a deployable table stowable in and deployable from a storage compartment, the table including a 4-hinge arch support structure including first and second primary pivot hinges disposed respectively at the opposite ends of the storage compartment, first and second lateral frame members having proximal ends connected respectively to the first and second pivot hinges, a medial frame member offset from and pivotally connected to distal ends of the first and second members through third and fourth medial pivot hinges, left-side, right-side and middle trays connected respectively to the first, second and third frame members and being foldable into and out of the storage compartment by articulation of the first, second, third and fourth joints, and means for locking at least one of the third and fourth joints to set the first, second and third frame members in a desired angular orientation with respect to each other.

Another object of the present invention is to provide a video conference center having a conference table which can be stowed and deployed on an as-needed basis with relative ease while using as little space as possible.

These and other objects and features of the invention will become more apparent with reference to the following detailed description and drawings.

DETAILED DESCRIPTION OF THE INVENTION

Figure 1:
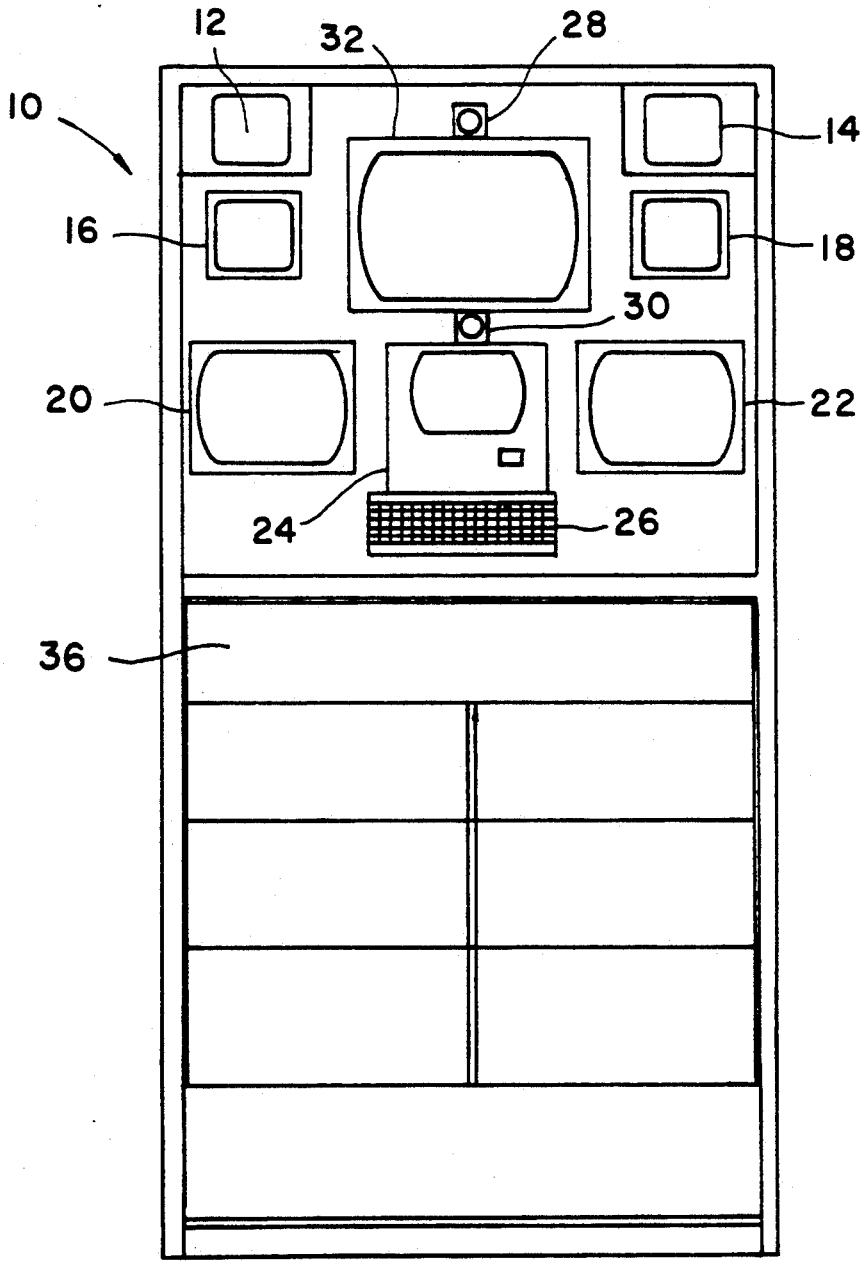
FIG. 1 is a front elevational view of a video conference center according to the present invention.
Figure 2:
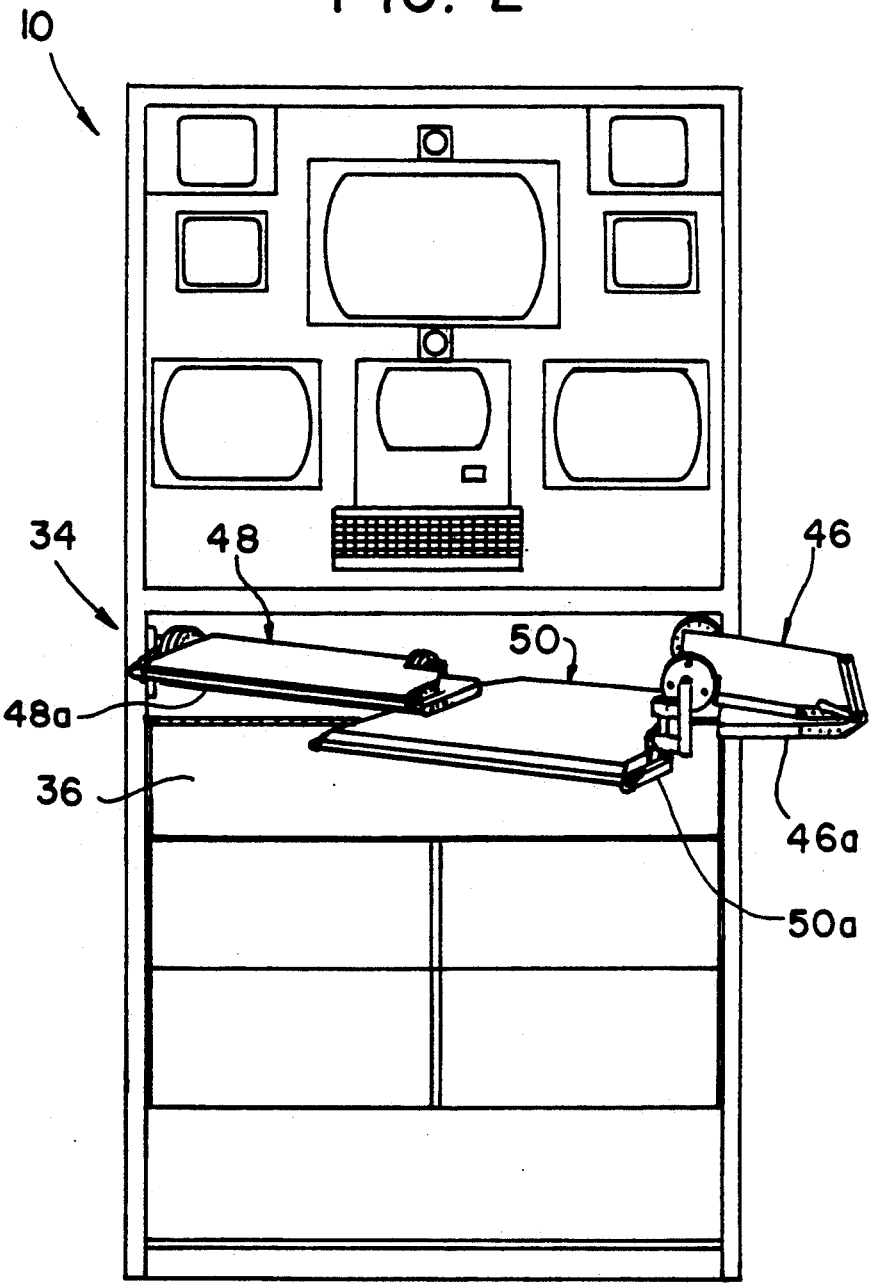
FIG. 2 is a front elevational view of the video conference center of FIG. 1, with the deployable conference table articulated out of its storage compartment into an asymmetric disposition.
Figure 3:
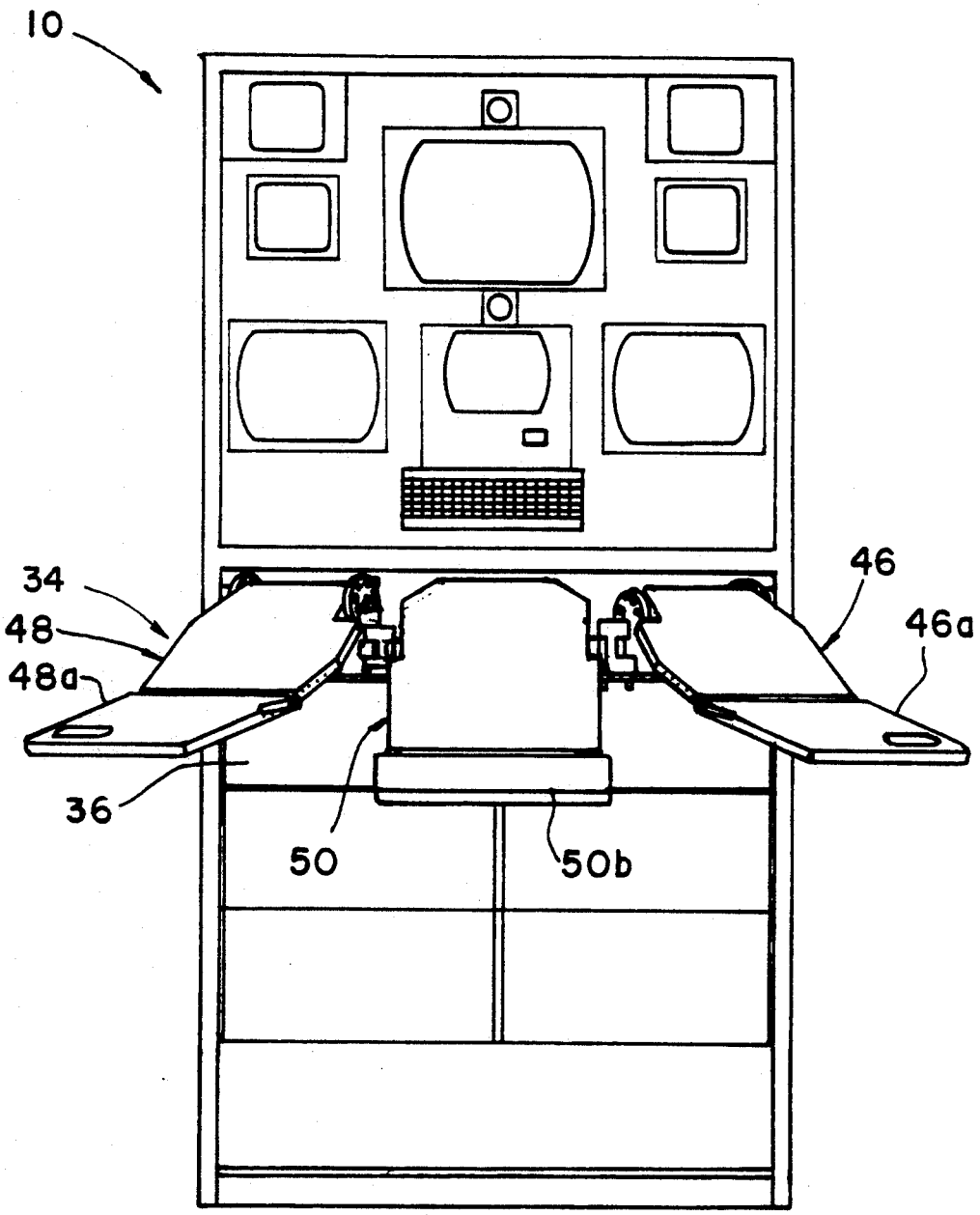
FIG. 3 is a front elevational view of the video conference center of FIG. 1 with the video conference table articulated out of its storage compartment into a symmetric orientation.

The present invention will be described below with respect to a specific embodiment in which a deployable video conference table is incorporated into an element control work station. In particular, the work station is designed for use in a space station as a pay load which is built into a rack of predetermined size. Referring to FIGS. 1–3, the work station 10 is about 42 inches wide, about 36 inches deep, and either 74 inches or 80 inches tall. If the work station 10 is used in a controlled environment space structure, or module such as a space station, it will be positioned in a lab module which would accommodate multiple "racks", each accommodating a separate functional unit. Thus, the work station 10 used as a video conference center would amount to one of several functional units of the lab module. Preferably, the work station 10 is positioned in roughly the center of either the "port" or "starboard" side of the lab module. The work station 10 provides a control center for the video systems, utility management and lab module-to-ground communications. The layout of the various components of the work station 10 takes into consideration various items such as anthropometric, ergonomic, neutral body posture, NASA MAN-System Integration Standard (NASA STD-3000) and perceptual and cognitive criteria for the work station 10.

A plurality of monitors 12, 14, 16, 18, 20, and 22 are arranged with the aforementioned considerations including the sightline zero-gravity in neutral body posture which drops to about 25° to 30° below horizontal. Centrally located within the station 10 is a computer or central processing unit CPU 24 having a monitor screen and an associated keyboard 26. Upper and lower video cameras 28 and 30, respectively, provide adequate viewing of the conference participants positioned in front of the work station 10. The central position of the CPU 24 emphasizes an anthropometrophic interpretation of symmetry and spatial cognition, in which the work station user can assign or select information or images on the basis of a left-right-center/up-down division of the work station.

The computer screen of computer 24 and the monitors 20 and 22 preferably two thirteen inch diagonal composite video monitors, one of either side of the CPU constitute the primary viewing/display surface of the work station 10. The crew member working at the work station 10 can see all of the primary work surfaces without needing to move his or her head.

The secondary viewing/display surfaces are vertical with respect to the lab module floor and would be used primarily from a distance greater than the primary viewing/display surface. The secondary viewing/display surface, which includes a central monitor 32 (preferably about 19 inches diagonal), will require the conference participant to raise his eyes or head. This monitor supports group video conferencing and (with a videoplexer and matrix switcher) also provides videoplexing of multiple images on the same screen, which may be controlled by using the CPU 24.

On either side of the large monitor 32, and substantially aligned at its bottom edge and having the same spatial orientation, are the two smaller monitors 16 and 18, of 9 inch or 10 inch diagonal, for example. These are preferably rotated about 7° on the horizontal. The monitors 12 and 14 on either side of the monitor 32 at its top are dedicated safety status flat panel touch screen displays which are rotated on the horizontal and tilted slightly on the vertical for easier viewing.

The video cameras 28 and 30 allow people on the ground or in other parts of the space station to see the crew members or member at the work station 10. The cameras will have either wide angle or fish-eye lenses and are capable of viewing three crew members when seated or restrained by foot-loops, or otherwise situated in 1-G or 0-G at the three positions in front of the work station 10.

In order for one to three crew members to conduct a variety of tasks including planning, scheduling, on-orbit training, video conferencing and group discussions, the present invention employs a deployable video conference table 34 which is stowed within the work station 10 behind a close-out cover plate or door 36 which is hinged at the bottom to open and expose the table 34. The door 36 covers an opening that is only about six inches high and leads into a compartment for stowing the table 34. The compartment slopes from the face of the work station 10 rearwardly and downwardly at an angle of about 15° below the primary work surface monitors.

The deployable video conference table 34 of the present invention employs a support structure which is based on the principal of a 4-hinge arch. In normal terrestrial architecture, an arch has only two or three hinges, allowing it to act as a self-rigidizing structure. For example, the most common, stable self-rigidizing frame is based upon the triangle, which is analogous to a three-hinge arch. A four-hinge arch, analogous to a rectangular frame, is not self-rigidizing. The 4-hinge arch or frame collapses unless it has one of three possible devices to rigidize it: a diagonal or cross brace, a diaphragm, or very rigid joints. The details of the 4-hinge arch support structure will be described below.

The table assembly 34 folds or collapses on itself to stow within the work station 10. It rests in its folded position when stowed and is locked into a rigid deployed position by means of quick release detent pin locks, captive set screws, or other attached or removable fasteners which will also be described below. When the locking pins are inserted into the hinge joints, they provide the joint stiffness to make the whole frame rigid. In its fully deployed, symmetric position, shown in FIG. 3, frame members 38, 40, and 42 of the table 34 form a regular trapezoid with a line 44 substantially in a plane of the face of the work station 10 and extending between opposite end pivot axes A and B. The trapezoid or "half-hexagon" has 60° interior acute angles defined between the center lines of the lateral frame members 38 and 42 and the line 44, respectively, while the center lines of the frame members 38 and 42 define 120° interior obtuse angles with the center line of the medial frame member 40. Each frame member carries a tray or work surface 46, 48 and 50 fixedly connected thereto by any suitable means.

In order to deploy the conference table 34, a crew member first releases a latch, catch (not shown), set screw or other fastener and opens the door 36. The crew member then reaches about two cm into the stowage compartment to grasp either of a right-hand tray 46 or a left-hand tray 48, both of which are pivotally connected through hinges to a middle tray 50 in a manner to be described more fully below. Each tray and corresponding support member constitute one of three sections of the table 34 so that the table includes a left section, a middle section, and a right section. Each tray has a leaf **46*a*, 48*a*, and 50*a* which is pivotally connected to and foldable under primary surfaces 46*b*, 48*b* and 50*b*, respectively. After deployment of the frame member 38, 40 and 42 to a desired, locked-in position, the leaves can be rotated about corresponding pivot shafts 46*c*, 48*c* and 50*c* until a desired orientation is achieved with respect to the primary surfaces. Then, the adjusted position of the leaves can be locked into place by using a lock, such as a lever 46*d*, 48*d* and 50*d***, respectively, which creates tension between the opposite ends of the corresponding pivot pins. This type of lock can be found on bicycle front wheels to permit quick connection and disconnection by applying a tension load between the opposite ends of the shaft to squeeze together abutting portions of the primary surfaces and the leaves.

Figure 4:
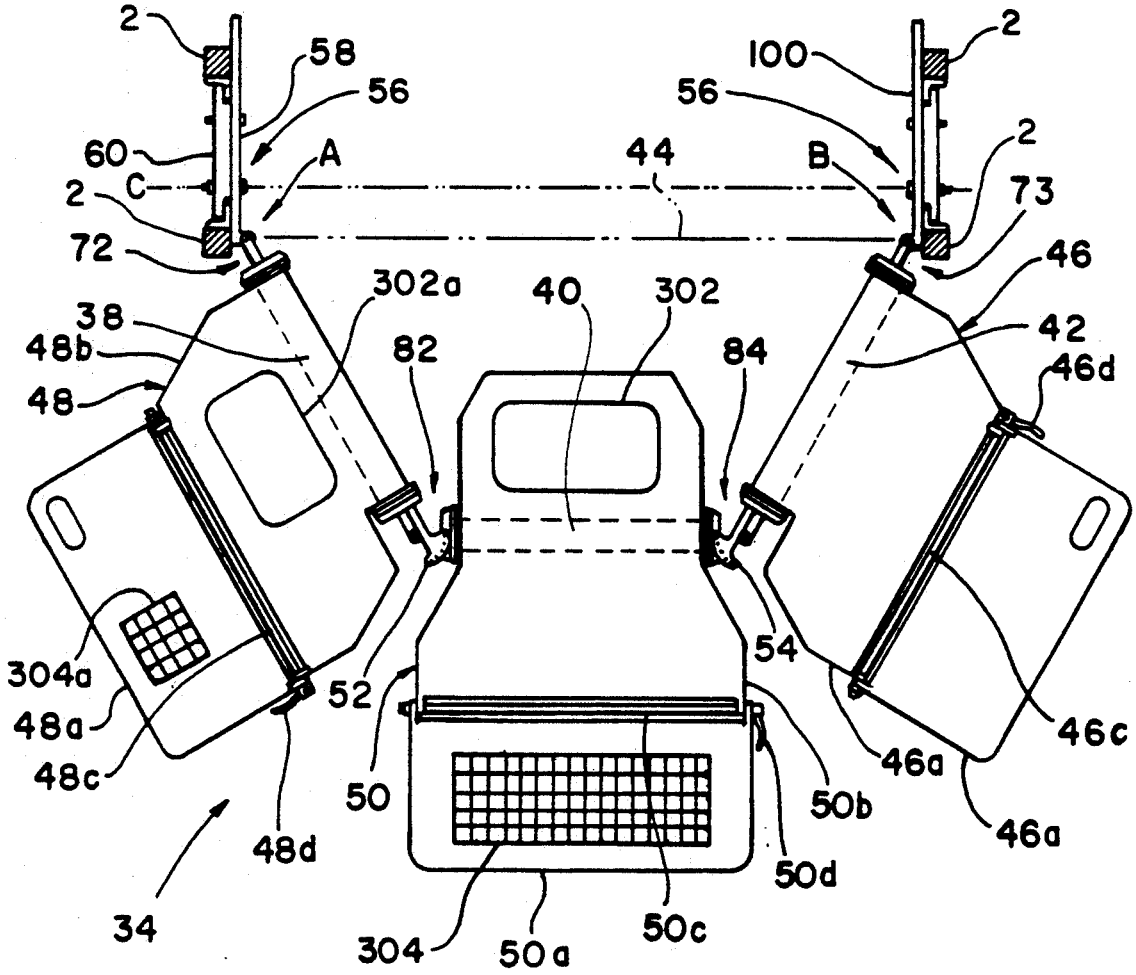
FIG. 4 is a top view of the video conference table assembly according to the present invention.

As the crew member pulls the table 34 out of the compartment with one hand, the 4-hinge arch unfolds so that the center section follows the side section that the crew member is drawing out of the compartment. The center section passes under the side sections, due to the fact that the center frame member 40 is offset below the two side sections. The center section passes under the side sections until it reaches its fully deployed position, as shown in FIG. 4, projecting further from the work station 10 than either of the side sections.

Once the sections are deployed in a desired position, the chosen position is locked in place by using either or both of two locking arms 52 and 54, each of which is provided with five holes disposed at equidistant intervals of, for example, 15° . A quick release detent pin is inserted into one of the five holes to lock the position of the entire 4-hinge arch structure. One pin in one of the locking arms is sufficient, although two pins corresponding to both arms could be used as well. Two locking arms offer the crew members more flexibility in response to whichever hand they use to pull on a side section and which hand they may have free.

Figure 5:
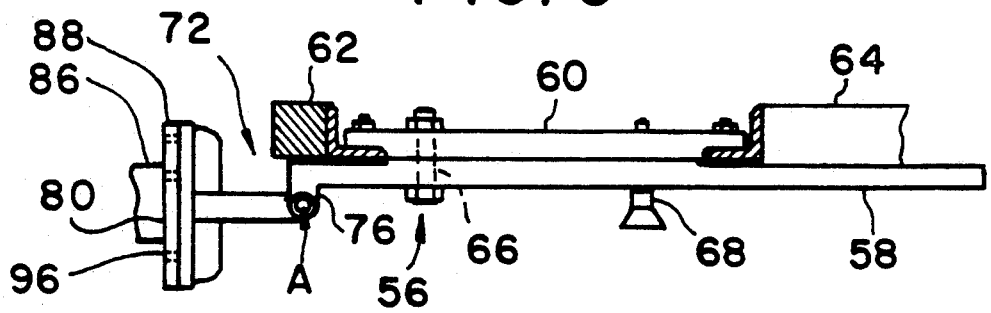
FIG. 5 is an enlarged top view, partly in section, showing one of the primary pivot hinges of the conference table of the present invention.
Figure 6:
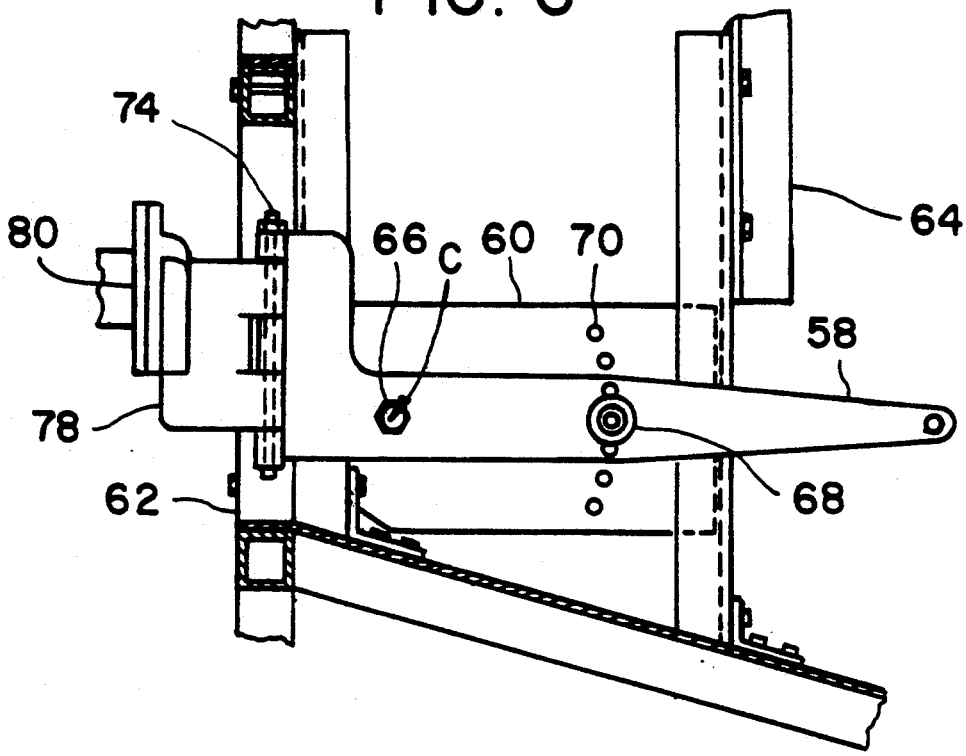
FIG. 6 is a side elevational view showing the pivot hinge of FIG. 5, and an adjusting lever for adjusting the angular orientation of the support structure of the conference table.

Once deployed out of the work station 10 and the 4-hinge arch structure is locked in place, it is possible to adjust the angle at which the entire table structure projects from the front of the work station 10 in vertical increments of, for example, 7.5° . In nominal deployed position, the arch frame structure projects upward from the front of the rack at about 15° optimal angle to resolve the requirements and demands of ergonomics, anthropometry, zero-gravity neutral body posture and NASA STD-3000 display screen viewing angles and distances. This orientation corresponds to the downward slope of the compartment. If the crew wishes to adjust the angular orientation of the entire arch frame structure into a horizontal position or a more inclined position, a quick release pin can be removed from either side of an internal pivot hinge lever arm (to be described below) and through the mounting plate to raise or lower the arch frame rotationally about its primary pivots, and then the pins can be reinstalled to hold the arch frame in the desired position. One of the internal pivot hinges is illustrated in FIGS. 5 and 6, which is one of the primary pivot points for pivoting the entire four arch structure about a horizontal axis which is parallel to the floor of the lab. The hinge 56 includes a lever 58 which is pivotally mounted to one side of the work station in the compartment. A mounting plate 60 is connected to one side of the work station by bolting to frame compartments 62 and 64. The lever 58 is pivotally connected to the mounting plate 60 through a pivot pin 66. The hinge 56 is thus rotatable about a pivot axis C. The annular orientation of the hinge 56 is fixed by pulling out a quick release pin 68 (and also a pin corresponding to the other hinge 57 on the opposite side) rotating the four arch frame structure to a desired position, and then inserting the quick release pin 68 (as well as the other pin) into one of a plurality of holes 70 provided in the mounting plate 60 on the same radius. The hole selected in mounting plate 60 will be the same as the corresponding hole on the mounting plate 99 of the hinge 57.

The hinges 56 and 57 thus provide means for pivoting the entire 4-hinged arch structure in unison relative to the work station 10. The pivot axis C of hinges 56 and 57 is thus orthogonal to the pivot axes of the individual hinges of four arch structure itself. Thus, it should be clear that the hinges provided at opposite sides of the compartment for pivoting the 4-hinge structure do not form part of the 4-hinge arch. The first hinge of the 4-hinge arch structure is the primary pivot hinge 72, which has the pivot axis A. This hinge is carried by the lever 58 of the hinge 56 and includes a pivot pin 74 provided in a bracket 76 formed at one end of the lever 58. A hinge plate 78 interleaves with the bracket 76 and is pivotally connected thereto through the pivot pin 74. A stationary member in the form of a disk 80 is fixedly connected to a distal end of the hinge plate 78 for connection to the frame member 38 in a manner to be described below.

As shown in FIG. 4, each of the trays 46, 48 and 50 are carried by respective frame members 38, 40 and 42 of the 4-hinge arch. Primary pivot hinges 72 and 73 connect the 4-hinge arch structure to the work station, while medial hinges 82 and 84 permit articulation of the frame members 38, 40, and 42 to offset stowage and deployment of the table. For simplicity, these disks and interleave hinge plates share the same geometry as hinges 82 and 84.

Figure 7:
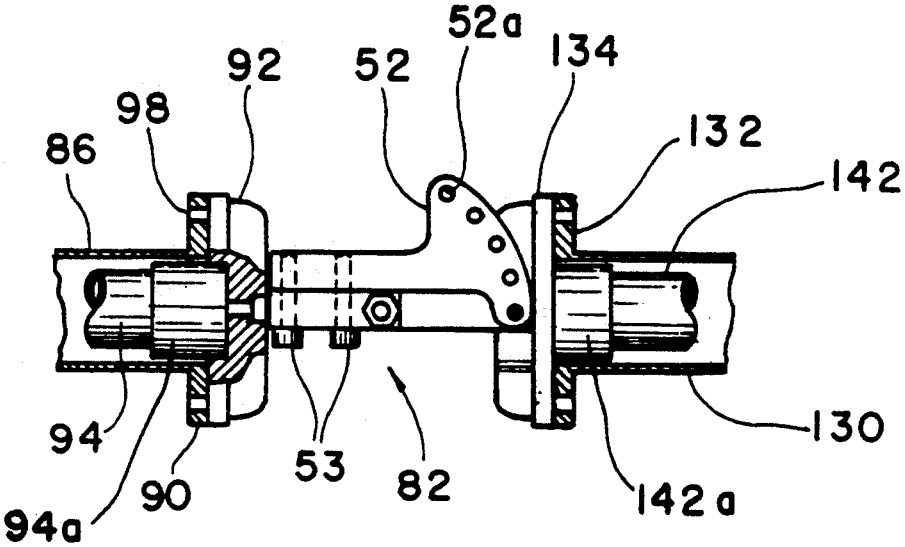
FIG. 7 is a top view, partly in section, showing one of the medial pivot hinges according to the present invention.

Referring to FIGS. 5–7, the left-side support 38 includes a rectangular outer hollow tube 86 which has connected at opposite ends thereof to disks 88 and 90. Since the disks 88 and 90 are fixedly connected to the square tube 86, both disks 88 and 90 rotate with the tube 86.

The tube 86 and disks 88 and 90 rotate between the stationary disk 80 and a stationary disk 92 fixedly connected to the hinge 82. A cylindrical inner hollow tube 94 has enlarged end portions which are fitted into corresponding recesses on the inner surfaces of the stationary disks 80 and 92 The leads placed on the deployed table surfaces are carried mostly by the inner tubes of the frame members 38, 40 and 42. The outer cylindrical surface of the enlarged end portions of the inner tube 94 provide a bearing surface on which the rotatable disks 88 and 90 are free to rotate. The outer tube 86, to which the tray 48 is connected is thus rotatable to a desired position. Once a desired position is established, a quick connect coupling pin or other fastener is extended through one of the plurality of holes 96 of the disk 88 and/or holes 98 of the disk 90 so as to fix the position of the tray 48.

Figure 10:
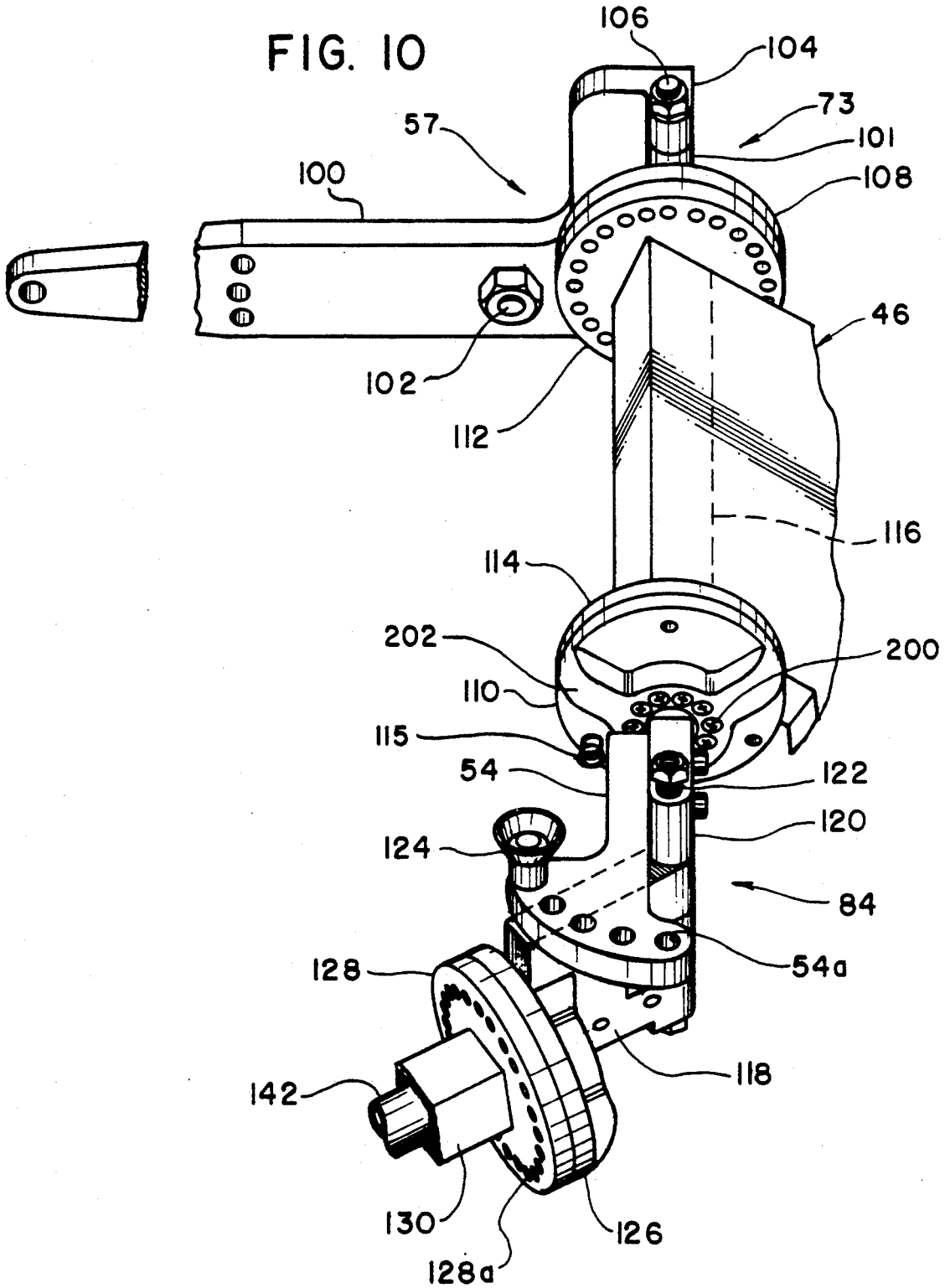
FIG. 10 is an enlarged, perspective view, showing one of the primary pivot hinges and one of the medial pivot hinges according to the present invention.

The opposite primary pivot hinge 73, as shown in FIG. 10, is constructed in the same manner as the hinge 72. Hinge 73 is carried by hinge 57 which includes a lever arm 100, a pivot pin 102 and a mounting plate 49. A bracket 104 of hinge 73 is formed at one end of the lever 100, and a pivot pin 106 interconnects the bracket with a hinge plate 101. Stationary disk 108 is fixedly connected to the hinge plate 101 while stationary disk 110 is carried by hinge 84. The stationary disks interlock with one or both rotatable disks 112 and 114 which are fixedly interconnected through a rectangular outlet tube 116. A Q.R.D. pin 115 passes through both the stationary disk 110 and any selected one of a plurality of holes (not shown) in the rotatable disk 114 to interlock the stationary and rotating elements of frame member 42. Of course, the tray 46 is fixedly connected to the outer tube 116 by any suitable means.

The medial hinge 84 includes two hinge plates 118 and 120 which interleave in an offset manner to allow the thus-connected trays to bypass above and below each other and are pivotally interconnected by a pivot pin 122. Stationary disk 110 is fixedly connected to hinge plate 120, as is the locking arm 54 releasably connectable to the hinge plate 118 by means of holes **54*a* provided in the locking arm 54 and a quick release detent pin 124 which passes through any one of the holes 54*a* and is received in a hole provided in the upper surface of the hinge plate 118 so as to position fixedly the hinge plates 118 and 120** relative to each other.

Hinge plate 118 is fixedly connected to a stationary disk which can be interlocked with a rotary disk 128 by means of a quick release detent pin (not shown) passing through one of the plurality of holes **128*a* of the rotary disk 128**.

Figure 8:
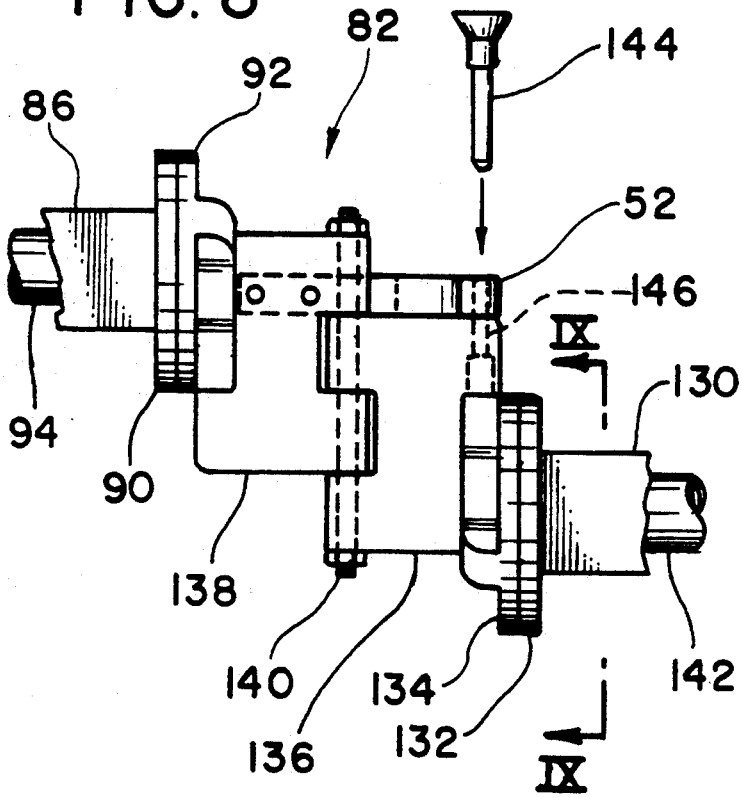
FIG. 8 is a side elevational view, partly cutaway, showing the medial pivot hinge of FIG. 7.
Figure 9:
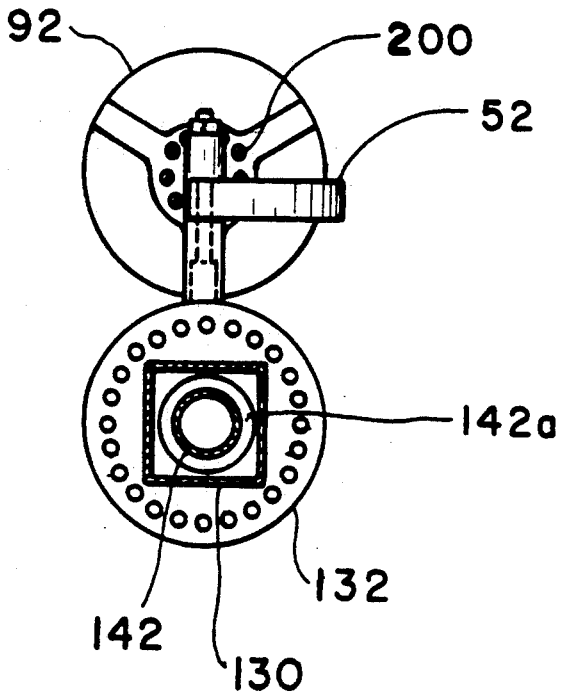
FIG. 9 is a sectional view taken along line IX—IX of FIG. 8.

Rotary disk 128 is connected to a rectangular outer tube 130 which, at its opposite end, is connected to a rotary disk 132 (FIGS. 7–9). The rotary disk 132 is capable of being interlocked with a stationary disk 134 which is fixedly connected to hinge plate 136 of the medial hinge 82. Hinge plate 136 interleaves with and is pivotally connected to a second hinge plate 138 through a pivot pin 140. The two stationary disks 126 and 134 are interconnected through an inner tube 142 having enlarged end portions **142*a* on which the rotary disks 128 and 132 can rotate. The locking arm 52 is fixedly connected to the hinge plate 138 by any suitable means to carry structural loads of DVCT assembly, such as threaded fasteners 53. The position of the hinge plates 136 and 138 relative to each other can be fixed by passing a detent pin 144 through one of the five holes 52*a* and into a hole 146 provided in the upper surface of the hinge plate 136**.

Once the crew member deploys the structural frame out from the work station 10, the arch frame locked and the vertical position set, there are three crew positions available: left, right and center. The work surfaces rotate and lock with quick release detent pins about the central structural tubes thus allowing the crew to adjust the orientation of the overall work surface. In the deployed position, the work surfaces may be unfolded to larger configurations by using the quick release, camlock mechanism which permits the use of the leaves which can be rotated through a range of about 225° and can be stowed on the underside of each corresponding primary surface. This may be further facilitated by providing corresponding recesses in the underside of the primary surfaces **46*b*, 48*b* and 50*b*. To release each corresponding lower leaf, the crew member turns or pushes the lever 46*d*, 48*d*, or 50*d*** to reduce tension between the ends of the pivot shaft, and then the lower leaf is moved to a desired position. To lock the lower leaf in the selected position, the crew member simply tightens the lever.

The locking arms 52 and 54 have multiple positions in 15° increments so as to allow the shape of the arch to be varied through several different configurations. In other words, a non-symmetric deployment may be desirable as shown in FIG. 2, for example. The non-symmetric orientation of the table structure can be locked in position using the same detent pins as in the case of the symmetric orientation. Regardless of the orientation, the contiguous work surface assemblies, each mounted upon a rotating tube assembly, bypass each other by means of the medial frame member 40 being offset from the side frame members 38 and 42, so that the central table section always passes below the side sections. This facilitates positioning the crew members at the same heights for the mounted video cameras. If the middle tray/work surface passed above the side trays, a crew member using it would be too high.

In order to stow the table, the lower leaf surfaces are first folded back into the compacted position under their respective primary surfaces. The rotating tubes are then aligned and locked back into the plane of the 4-hinge arch. The angle of the arch frame is adjusted to 15° upward from the pivot pins 66 and 102, so as to correspond to the 15° downward slope of the compartment. Then the lock pins of the locking arms 52 and/or 54 are removed and one corner of the arch frame is collapsed through the connecting hinge radii, followed by the second corner and the arch frame comes to a rest inside the stowage space.

The hinge mechanisms are based upon a hinge butt geometry that is applied equally in the two medial full butt hinge assemblies and the two side pivot hinge/half butt hinge assemblies. The design of the individual hinge butt allows the same part to be used in all four locations. The hinges accommodate both the swinging and bypassing functions because the design allows the inverted hinge assembly in the center position so that the hinge butt maintains exactly the same relationship between the hinge pin and the stationary disks in all locations. Also, each stationary disk 80, 92, 108, 110, 126, 134 is provided with a three-part flange (see FIG. 9) or the rear surfaces thereof to transfer the load from the inner tubes directly to the four hinges of the 4-hinge support structure. Also, various other may be employed to lock the 4-hinge arch in a desired position, including cam mechanisms, fasteners, etc.

Figure 11A:
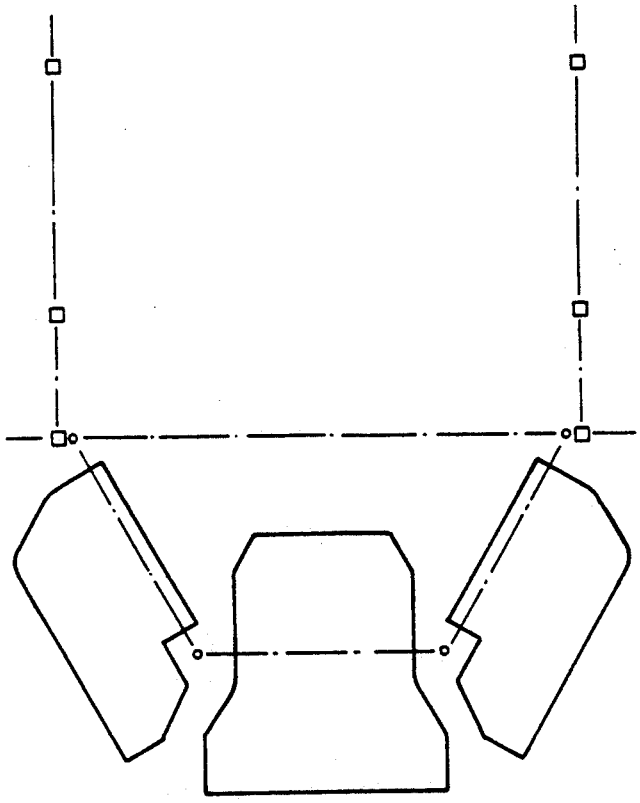
FIGS. 11A–11E are sequential views showing the video conference according to the present invention moving from a deployed position to a stowed position.
Figure 11B:
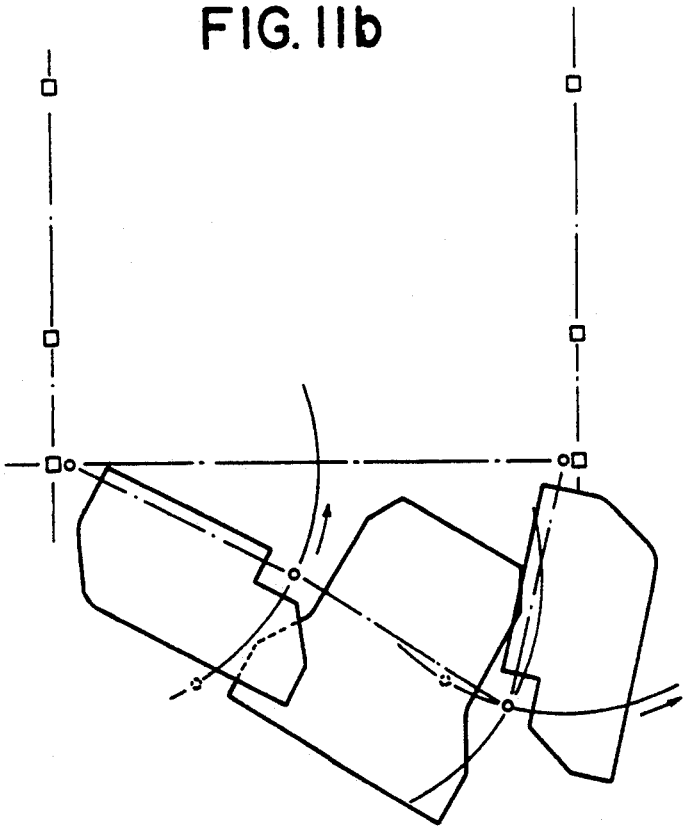
Figure 11C:
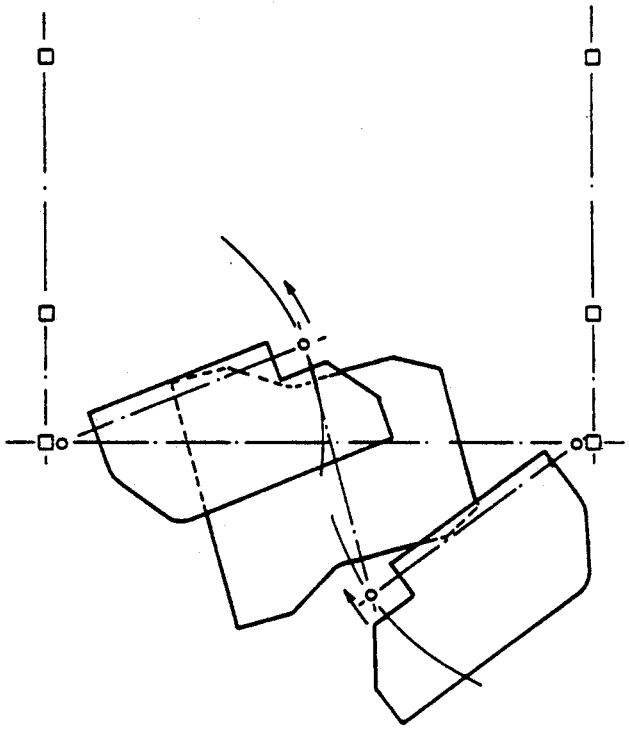
Figure 11D:
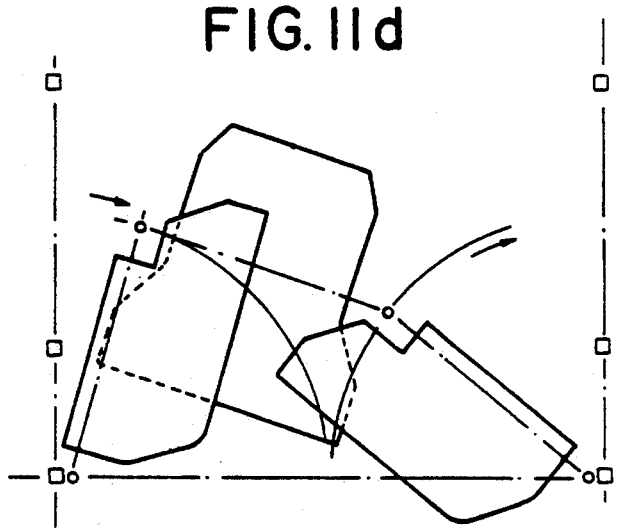
Figure 11E:
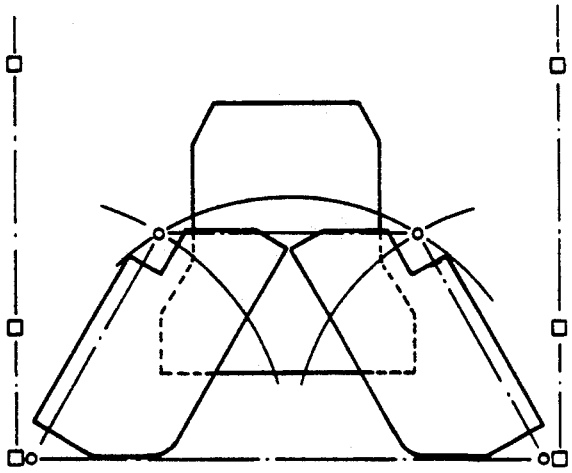

FIGS. 11A–11E sequentially show how the video conference table of the present invention is articulated from a deployed to a stowed position. In FIG. 11A, the work surfaces are fully deployed in symmetrical "half-hexagon" configuration. The 4-hinge arch may be locked at the hinges to maintain this position. In order to move the surfaces into the stowed position, the hinges are first unlocked and then the 4-hinge arch is folded into itself, beginning as shown in FIG. 11B. First, the left hinge swings in and the right hinge swings out and away. The hinges may be locked in this position or in other asymmetrical deployed positions, depending upon the needs of the crew members or the video conference participants. However, if the conference table is to be stowed, a continued folding occurs as shown in FIGS. 11C and 11D. With respect to FIG. 11C, the left work surface swings into the rack for collapsed stowage. The center surface passes under the side surfaces. As shown in FIG. 11D, the work surfaces swing into the rack with the left surface swinging to the limit of its range of travel. Finally, as shown in FIG. 11E, all work surfaces are fully stowed inside the rack, allowing the front "close mount" panel to close. Stowage position may be symmetrical, or there is room for some variation in asymmetrical stowage positions.

Referring to FIG. 9 and 10, the disks are provided with stiffener grids 202 which help carry structural and proportional loads. These grids are formed to extend radially outward from a hub which is provided with a plurality of angularly dispersed holes which receive screws 200. The screws 200 connect to spring anchors embedded in the thickened ends of the cylindrical inner hub **34*a* and 142*a*** so as to carry the structural load of the assembly.

The pins which are used to lock the 4-point hinge into a deployed position can have other suitable structures. For example, pin 144 in FIG. 8 may be a captive set screw or other attached or removable fastener. Also, other features may be added to the structure to facilitate video conferencing. For example, in FIG. 4, the middle table section may be provided with a keyboard 304 and the upper portion may be provided with a video monitor 302. These may be connected to a computer or other devices through suitable means (not shown). Also, numeric keypad 304 may be provided in one of the tables along with a video screen **302*a***.

With respect to the video conference table supporting structure, a walk frame structure is generally referred to by the numeral 2 to indicate vertical support members. However, any suitable frame structure may be employed, depending on the intended use of the table. The table may be employed in areas other than air space applications, including areas of 1-G. If used in a 1-G environment counter-weights may be mounted on the end of the lever 58 (FIG. 6) through the hole provided in the end of the lever 58.

This opening structure described above provides a deployable table which provides one or more pairs or sets of primary and secondary work surfaces that adjust both in height above the floor and in angle separately or together. Moreover, the table provides primary and secondary work surfaces that may be combined with computer components such as display screens or keyboards such that they are adjustable through a whole range of heights and relative angles to each other for more flexible than conventional "lap-top" use.

Also, the table according to the present invention can be easily operated, deployed and/or stowed by users or crew members in a range of gravity conditions, not just zero-gravity or 1-G.

While the present invention has been described with respect to an embodiment that has particular usefulness in a space vehicle, such as a space station, it is also applicable to a number of crowded high-technology work environments, including ships, submarines, airplanes, trains, etc. Any laboratory environment that utilizes deep racks may be suitable for this type of deployable work surface.

We claim:

1. A deployable table stowable in and deployable from a storage compartment, comprising:

a 4-hinge arch support structure including first and second primary pivot hinges disposed respectively at the opposite ends of the storage compartment, first and second lateral frame members having proximal ends connected respectively to the first and second pivot hinges, a medial frame member offset from and pivotally connected to distal ends of the first and second members through third and fourth medial pivot hinges;

left-side, right-side and middle trays connected respectively to the first, second and third frame members and being foldable into and out of the storage compartment by articulation of the first, second, third and fourth joints; and means for locking at least one of the third and fourth joints to set the first, second and third frame members in a desired angular orientation with respect to each other.

2. A deployable table according to claim 1, further comprising means for pivoting the four-arch support structure in unison about an axis orthogonal to the pivot axes of the first, second, third and fourth hinges.

3. A deployable table according to claim 2, wherein the pivoting means comprises first and second levers, each including first and second ends, a pivot pin about which each of the first and second levers is pivotally movable, the first end of each lever having mounted thereto a corresponding one of the first and second hinges, each lever including means for adjusting the angular position of each corresponding lever.

4. A deployable table according to claim 3, wherein each adjusting means comprises a mounting plate having a plurality of holes formed on a common radius, and a locking pin passing through each corresponding lever and into one of the plurality of holes of the corresponding mounting plate.

5. A deployable table according to claim 1, further comprising means for rotating each of the first, second and third frame members about respective rotation axes.

6. A deployable table according to claim 5, wherein the rotating means comprises, for each of the first, second and third frame members, a pair of stationary members connected to adjacent ones of the first, second, third and fourth hinges, wherein each frame member includes a pair of rotary members connected to opposite ones of the ends of each corresponding one of the first, second and third frame members in opposing relationship with each corresponding pair of stationary members, and means for interlocking at least one of the rotary members of each pair of rotary members with an opposing one of the stationary members of each corresponding pair of stationary members.

7. A deployable table according to claim 6, wherein the interlocking means comprises a plurality of holes provided in at least one of the rotary members, and a locking pin extending through each corresponding stationary member and into one of the plurality holes of the corresponding rotary member.

8. A deployable table according to claim 1, wherein each of the left-side, right-side and middle trays includes a primary surface and a leaf pivotally connected to the primary surface.

9. A deployable table according to claim 8, wherein each of the left-side, right-side and middle trays includes a pivot pin interconnecting the primary surface and the leaf to provide relative pivotal movement between each primary surface and each corresponding leaf, and means for fixing the angular orientation of each leaf relative to each corresponding primary surface.

10. A deployable table according to claim 9, wherein the fixing means comprises a lever disposed on one end of each pivot pin for providing a compressive load which interlocks each primary surface with its corresponding leaf.

11. A deployable table according to claim 1, wherein each of the third and fourth medial pivot hinges includes first and second hinge plates interconnected through a hinge pin, and wherein the locking means comprises a first locking arm fixedly connected to the first hinge plate of the third hinge and being releasably connectable to the second hinge plate of the third hinge, and a second locking arm fixedly connected to the first hinge plate of the fourth hinge and being releasably connectable to the second hinge plate of the fourth hinge.

12. A deployable table according to claim 11, wherein each of the first and second locking arms includes a plurality of holes and a locking pin fitted in one of the plurality of holes and extending therethrough into a hole provided in the corresponding second hinge plate.

13. A deployable video conference center comprising:

a work station including a plurality of video monitors, at least one video camera, and a support structure which defines a storage compartment;

an articulate table assembly stowable in and deployable from the storage compartment; and a door covering the compartment when the table assembly is stowed in the compartment, the articulate table assembly including a 4-hinge arch support structure including first and second primary pivot hinges disposed respectively at the opposite ends of the storage compartment, first and second lateral frame members having proximal ends connected respectively to the first and second pivot hinges, and a medial frame member offset from and pivotally connected to distal ends of the first and second members through third and fourth medial pivot hinges.

14. A video conference center according to claim 13, wherein the table assembly further includes:

left-side, right-side and middle trays connected respectively to the first, second and third frame members and being foldable into and out of the storage compartment by articulation of the first, second, third and fourth joints; and means for locking at least one of the third and fourth joints to set the first, second and third frame members in a desired angular orientation with respect to each other.

15. A video conference center according to claim 14, further comprising means for pivoting the 4-hinge arch support structure in unison about an axis orthogonal to the pivot axes of the first, second, third and fourth hinges.

16. A video conference center according to claim 15, wherein the pivoting means comprises first and second levers, each including first and second ends, a pivot pin about which each of the first and second levers is pivotally movable, the first end of each lever having mounted thereto a corresponding one of the first and second hinges, each lever including means for adjusting the angular position of each corresponding lever.

17. A video conference center according to claim 16, wherein each adjusting means comprises a mounting plate having a plurality of holes formed on a common radius, and a locking pin passing through each corresponding lever and into one of the plurality of holes of the corresponding mounting plate.

18. A video conference center according to claim 14, further comprising means for rotating each of the first, second and third frame members about respective rotation axes, thus allowing the whole frame structure to expand or fold-in around the respective rotation axes.

19. A video conference center according to claim 18, wherein the rotating means comprises, for each of the first, second and third frame members, a pair of stationary members connected to adjacent hinges, a pair of rotary members connected to opposite ends of each corresponding one of the first, second and third frame members in opposing relationship with the corresponding pair of stationary members, and means for interlocking at least one of the rotary members of each pair of rotary members with an opposing one of the stationary members of each corresponding pair of stationary members.

20. A video conference center according to claim 19, wherein the interlocking means comprises a plurality of holes provided in at least one of the rotary members, and a locking pin extending through each corresponding stationary member and into one of the plurality holes of the corresponding rotary member.

* * * * *